US006443265B1

(12) United States Patent
Nakamori et al.

(10) Patent No.: US 6,443,265 B1
(45) Date of Patent: Sep. 3, 2002

(54) SAFETY DEVICE OF THE ELEVATOR DOOR

(75) Inventors: Masanori Nakamori, Yokohama (JP); Motohiro Higashide, Inagi (JP); Sai Seii, Niiza (JP)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/723,393

(22) Filed: Nov. 28, 2000

(30) Foreign Application Priority Data

Dec. 6, 1999 (JP) ..... 11-345605

(51) Int. Cl.[7] ..... B66B 13/26
(52) U.S. Cl. ..... 187/317; 187/316
(58) Field of Search ..... 187/314, 313, 187/317, 414, 316; 49/27, 120

(56) References Cited

U.S. PATENT DOCUMENTS 4,693,340 A * 9/1987 Shanks et al. ..... 187/317
5,394,961 A * 3/1995 Biver ..... 187/317
5,641,951 A * 6/1997 Cai et al. ..... 187/317

FOREIGN PATENT DOCUMENTS

JP 4-286588 A * 10/1992 ..... 187/317
JP 5-310390 A * 11/1993 ..... 187/317
JP 5-330772 A * 12/1993 ..... 187/317

* cited by examiner

*Primary Examiner*—Eileen D. Lillis
*Assistant Examiner*—Thuy V. Tran

(57) ABSTRACT

A safety device for an elevator door characterized by the following facts: a lever (2) with one end (3) pivoted at an elevator door safety shoe (1) has its other end (4) fixed and supported on each floor in a rotatable manner; a polarized reflection plate (11) is supported at one end of a link lever (8) which has its other end pivoted to the aforementioned lever (5) to swing around a pivot point (9); a detector (12) facing the polarized reflection plate (11) is connected to a controller (15); and the controller is connected to the door operator (16).

2 Claims, 1 Drawing Sheet

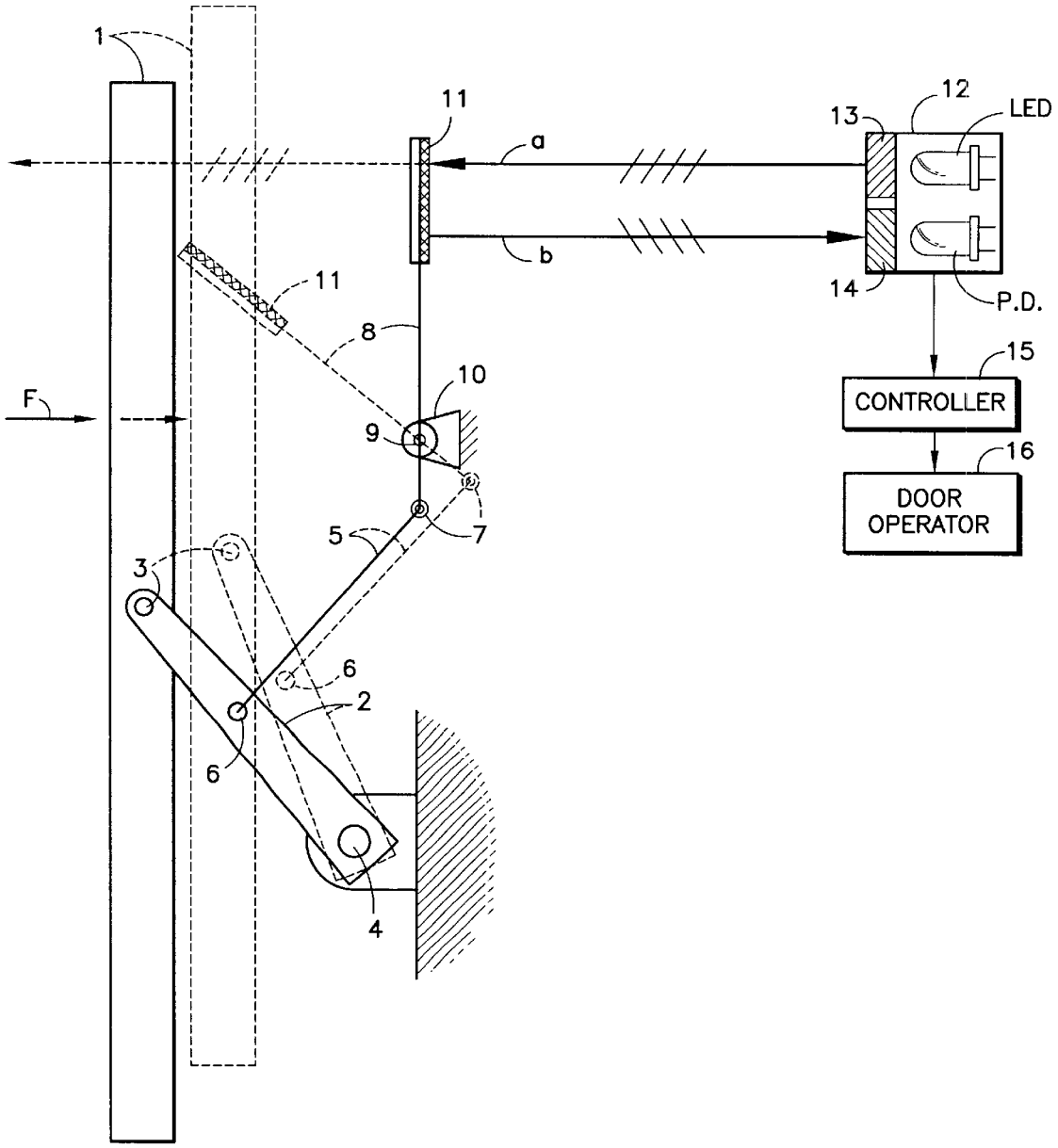
1
11
a
12
13
LED
b
14
P.D.
11
8
10
F
9
15
CONTROLLER
16
DOOR
OPERATOR
5
7
3
6
2
6
4

SAFETY DEVICE OF THE ELEVATOR DOOR

TECHNICAL FIELD OF THE INVENTION

The present invention relates to a safety device for an elevator door. In particular, it relates to an improvement on the elevator door safety shoe which controls the opening and closing of an elevator door.

BACKGROUND

An elevator door safety shoe is a plate interposed in the space formed between the elevator car and the floor of each story, and is a safety device that prevents the elevator door from opening and closing when the elevator car makes an abnormal contact, such as colliding, etc. with the plate after the elevator car ascends and stops at each story.

Conventionally, this elevator door safety shoe was controlled with a microswitch which has a cable.

However, in an elevator door safety shoe controlled with a microswitch which had a cable, there were inconveniences concerning low reliability of the elevator door safety device since the cable is bent each time the door is opened and closed, eventually tending to disconnect easily along with the cost of maintenance increasing.

Therefore, the present invention aims to improve on the reliability of the elevator door safety device.

SUMMARY OF THE INVENTION

In order to solve the aforementioned problems a safety device for an elevator door characterized by the following facts: a lever with one end pivoted at an elevator door safety shoe has its other end fixed and supported on each floor in a rotatable manner; a polarized reflection plate is supported at one end of a link lever which has its other end pivoted to the aforementioned lever to swing around the pivot point; a detector facing the polarized reflection plate is connected to a controller; and the controller is connected to the door operator. Also, it is characterized by the fact that the detector has an LED as a light emitting element which is opposite an X-axis polarization filter and a photo diode as a light receiving element which is opposite a Y-axis polarization filter.

Therefore, when an abnormality occurs in the elevator door safety shoe, the lever and the link lever rotate in connection with the operation thereof, the polarized light reflection plate tilts, the infrared ray emitted from the detector exactly opposite to it ceases to be reflected at the polarized light reflection plate, an abnormality at the pertinent story is detected, and opening and closing of the elevator door becomes impossible. When the elevator door safety shoe returns to a normal state, the lever and the link rotate in reverse and are restored to the normal state so the polarized light reflection plate is exactly opposite the detector. This type of operation is executed via the lever and the link lever, so failure of the elevator door safety device caused by non-operation of the prior art microswitch due to disconnection of the cable is avoided.

BRIEF DESCRIPTION OF THE DRAWING

FIG. 1 is a schematic diagram showing an application example of the present invention.

DETAILED DESCRIPTION OF THE BEST MODE

Below, an embodiment of the present invention will be explained. In FIG. 1, 1 is the elevator door safety shoe, 2 the lever in which one end is pivotally supported 3 to elevator door safety shoe 1 and the other end part is pivotally supported 4 at each story to be able to swing, and 5 the link lever in which one end is pivotally supported 6 at the approximately center part of the lever 2 so as to be able to swing. The other end part of link lever 5 is linked to the one end of reflection plate support rod 8 via universal joint 7. Reflection plate support rod 8 is supported by bracket 10 to be able to swing at each story on pivot 9.

Polarized light reflection plate 11 is coupled to the other end of reflection plate support rod 8, and detector 12 is fixed and supported at the part facing this polarized light reflection plate 11. Detector 12 has x-axis polarization filter screen 13 which faces an LED (light emitting diode) as the built-in light emitting element and y-axis polarization filter 14 which faces a P.D. (photo diode) as the built-in light receiving element, and is composed to make the infrared ray emitted by the LED into infrared ray (a) which is polarized to the x axis at the x-axis polarization filter 13, this is reflected into polarized infrared ray (b) which is converted to the y-axis, is input into controller 15 by being received by the P.D., controller 15 inputs a safety signal to door operator 16, and based on this opens and closes the elevator door.

Therefore, when elevator door safety shoe 1 moves in the arrow F direction by the elevator car (not shown) colliding, etc., with elevator door safety shoe 1, as indicated by the virtual line in FIG. 1, lever 2 rotates with shaft 4 as the center so link lever 5 rotates, and by this, reflection plate support rod 8 rotates in the opposite direction from the arrow F direction, thus polarized light reflection plate 11 tilts and collapses and the infrared ray emitted from the LED is not reflected and polarized. Therefore, the elevator door takes on a state incapable of being opened and closed since the polarized infrared ray is not input to the P.D.

Therefore, when elevator door safety shoe 1 returns to the original state, lever 2 and link lever 5 rotate and polarized light reflection plate 11 is exactly opposite detector 12 so infrared ray (a) polarized to the x-axis is received in the P.D. as polarized infrared ray (b) which is converted to the y-axis, so the fact that it is in this state indicates that the opening and closing of the elevator door can be executed safely.

The present invention is composed to be able to detect an abnormality of the elevator door safety shoe by transmitting the operation of the elevator door safety shoe to the polarized light reflection plate with a lever instead of a cable, so the danger of detection incapability caused by disconnection of the cable can be avoided and improvement in the reliability of the elevator door safety device can be achieved, and thus the cost of maintenance can be reduced greatly.

We claim:

1. A safety device for an elevator door characterized by the following facts: a shoe lever with one end pivoted at an elevator door safety shoe and having its other end fixed and supported on each floor in a pivotable manner; a polarized reflection plate, supported at one end of a link lever and having its other end pivoted to the aforementioned shoe lever to swing around an intermediate pivot point; a detector facing the polarized reflection plate connected to a controller; and the controller being connected to the door operator.

2. The safety device of elevator door noted in claim 1, in which the detector has an LED as a light emitting element which is opposite an X-axis polarization filter and a photo diode as a light receiving element which is opposite a Y-axis polarization filter.

* * * * *